United States Patent [19]

Meyer

[11] 4,241,562

[45] Dec. 30, 1980

[54] METHOD AND APPARATUS FOR AUTOMATIC FILLING OF BAGS

[76] Inventor: Alfons Meyer, Donauschwabenstrasse 40, D-7050 Waiblingen, Fed. Rep. of Germany

[21] Appl. No.: 34,260

[22] Filed: Apr. 30, 1979

[30] Foreign Application Priority Data

May 6, 1978 [DE] Fed. Rep. of Germany ..... 2819888
Apr. 3, 1979 [DE] Fed. Rep. of Germany ..... 2913224

[51] Int. Cl.[3] ..... B65B 63/02; B65B 43/22; B65B 43/36

[52] U.S. Cl. ..... 53/438; 53/459; 53/67; 53/529; 53/571; 53/258; 53/385

[58] Field of Search ..... 53/438, 459, 469, 529, 53/571, 570, 572, 67, 69, 258, 385

[56] References Cited

U.S. PATENT DOCUMENTS

| | | | |
|---|---|---|---|
| 3,217,464 | 11/1965 | Feingold | 53/572 |
| 3,507,090 | 4/1970 | D'Angelo | 53/570 X |
| 3,552,090 | 1/1971 | Roberts et al. | 53/570 X |
| 3,908,343 | 9/1975 | Farrelly | 53/570 X |
| 4,047,362 | 9/1977 | Lister et al. | 53/572 |
| 4,157,003 | 6/1979 | Kamphaus | 53/572 |

*Primary Examiner*—Travis S. McGehee
*Attorney, Agent, or Firm*—Frishauf, Holtz, Goodman & Woodward

[57] ABSTRACT

A method and apparatus for the automatic filling of plastic bags with, for example, elastic, soft and deformable contents. In order to provide for the automatic handling of empty bags without intermediate, especially manual, steps, the invention provides that the empty bags are attached by extending flaps to a plastic carrier web across a tear line. The apparatus of the invention places a quantity of goods into the bag by means of an axially moving filling piston which passes between spreadable jaws that hold the bag open. The continued motion of the filling piston eventually exerts a force sufficient to cause fracture along the tear line and separation of the filled bag from the flap which stays attached to the carrier web. The piston then moves the filled bag into position for sealing. A number of embodiments is presented.

35 Claims, 8 Drawing Figures

METHOD AND APPARATUS FOR AUTOMATIC FILLING OF BAGS

FIELD OF THE INVENTION

The invention relates to automatic package handling and filling machinery. More particularly, the invention relates to a machine for the automatic filling of, for example, plastic bags with soft goods.

BACKGROUND OF THE INVENTION

It is known in the art, for example from the German Offenlegungsschrift DE-OS No. 26 34 216 to process bags by an intermediate storage after manufacture and by supplying these bags to the filling machine in a predetermined cyclic manner. The bags are stored after manufacture by being located between two adjacent parallel webs which are wound up in a storage spool from which they are individually delivered to the subsequent processing station. In order to handle the individually delivered bags, the bag filling machine must be equipped with special handling machinery for receiving and correctly positioning the bags and for delivering them to the filling station at the proper time. This additional equipment increases the expense of the bag filling machine and substantially reduces the operating speed of the bag filling machine because of the additional intermediate steps required to handle the empty bags.

OBJECT AND SUMMARY OF THE INVENTION

It is thus a first principal object of the invention to provide a method for the automatic filling of bags which permits a high rate of production with great precision while also making possible a relatively simple construction of the associated bag filling equipment.

Briefly, according to the invention, a supply of plastic bags is used, each of which is attached by means of an extending flap to a continuous carrier web. After the goods have been inserted into the bag by means of a filling piston, the continued motion of the piston causes a fracture of the bag at a tear line which separates it from the flap which remains attached to the carrier web.

The rigid and permanent attachment of each of the flaps of the bags to the carrier web prealigns these bags in the simplest possible manner and permits a precise positioning and supply of the empty bags for the bag filling machine. This alignment and positioning is inherent in the supply of bags and does not require additional equipment within the bag filling machine, in particular mechanical vacuum fingers, etc. which might damage sensitive goods. Thus the method according to the invention makes it possible to handle even goods that are difficult to handle, for example, soft goods such as sanitary napkins, etc. at a high rate of production and to package them in bags. The cooperation of the filling piston with a filling funnel is obtained by making the motion of the funnel dependent on the displacement of the piston. The opening motion of the funnel spreads the bag and permits the goods to enter. The spreading motion of the jaws of the funnel can be in the horizontal or vertical direction. The goods themselves are advantageously provided to the filling machine in a direction which is perpendicular to the normal motion of the filling piston. A quantity of goods equal to one bag content is placed in front of the filling piston in one position of the machine. After the bag is filled, the filling funnel is closed automatically and is thus ready for opening the next bag. In an advantageous feature of the invention, the presence of the next unfilled bag is sensed by appropriate sensors after which the carrier web is advanced by a distance equal to the length necessary to place the new bag in the proper position. By suitably adjusting the length of the transport step, it is possible to compensate for any differences and tolerances in the manufacture of the bags or in their attachment to the carrier web.

An associated principal object of the invention is to provide an apparatus for carrying out the method of the invention. The apparatus according to the invention includes a bag filling piston which can be moved in a direction opposite to the direction of motion of the carrier web so as to place goods within the empty opened bag. The stroke of the filling piston is so adjusted that it continues beyond the position in which the goods have been inserted in the bag and exerts an axial force on the bag which separates it by fracture along a fracture line from the attachment flap which is permanently welded to the carrier web. The continued motion of the filling piston places the separated bag in position for closure or further processing.

In an advantageous feature of the invention, the plastic bag is fully opened by a filling funnel which has two pivotable jaws that hold the bag open for the passage of the filling piston and the goods therethrough. The opening of the bag may additionally be aided by the supply of compressed air. It is an advantageous feature of the invention that the spreading motion of the filling funnel is coupled to the advance of the filling piston.

The filling funnel may advantageously be returned to its initial closed state by, for example, a spring. The bag filling apparatus according to the invention is advantageously equipped with a cylically operating heat-welding mechanism for closing the filled bag by welding. The apparatus advantageously includes a material supply mechanism which supplies a predetermined quantity of goods equal to the contents of a single bag into position in front of the filling piston in a rhythm which is coupled with the motions of the piston and the other parts of the machine.

Other features and advantages of the invention will emerge from a reading of the description of preferred exemplary embodiments of the invention.

DESCRIPTION OF THE PREFERRED EMBODIMENTS

Figure 1:
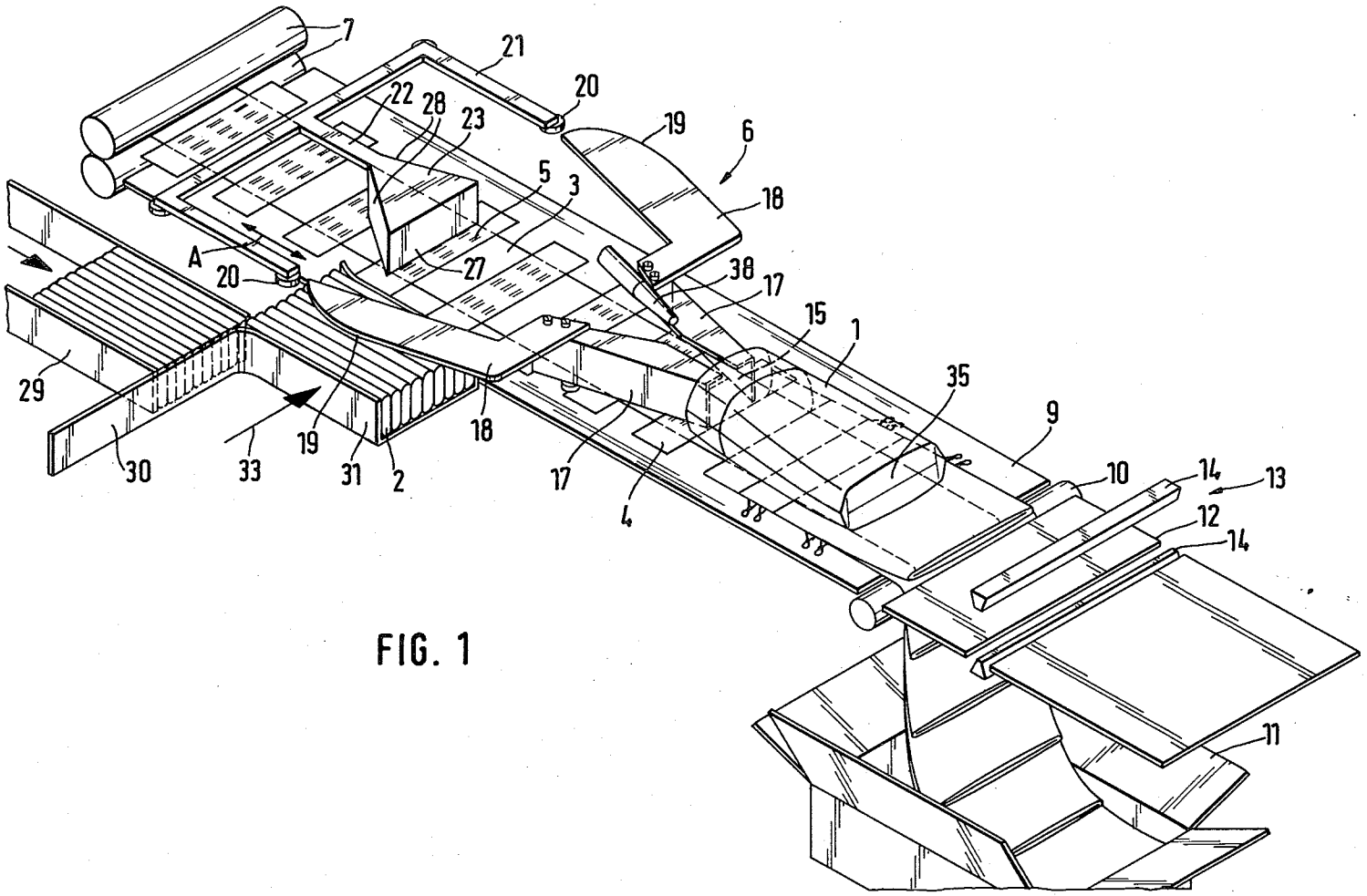
FIG. 1 is a perspective view of a first embodiment of the invention in an initial position after an opened bag has slipped over the filling funnel.
Figure 2:
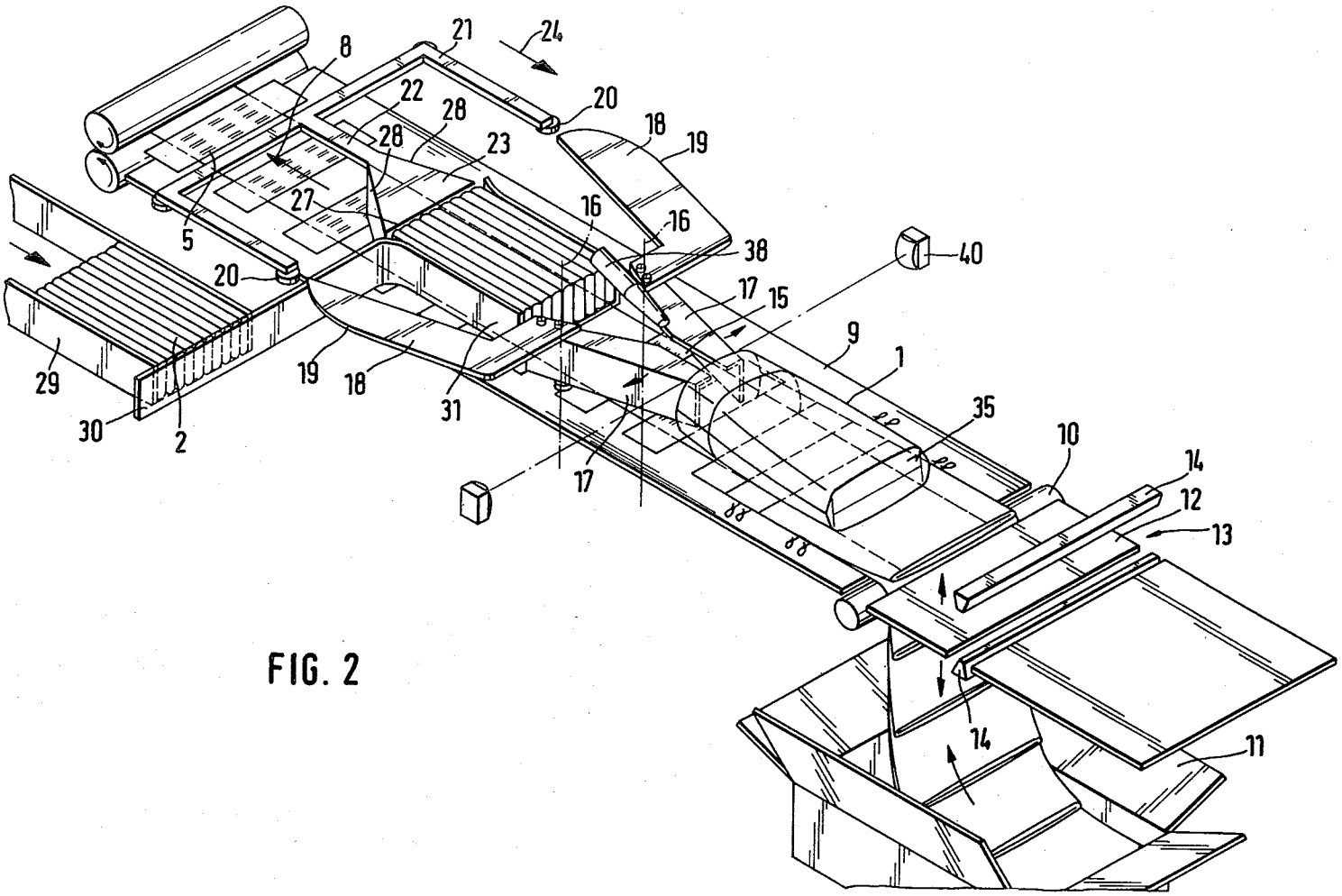
FIG. 2 is an illustration of the apparatus of FIG. 1 in a subsequent step after the filling funnel has opened the bag.
Figure 3:
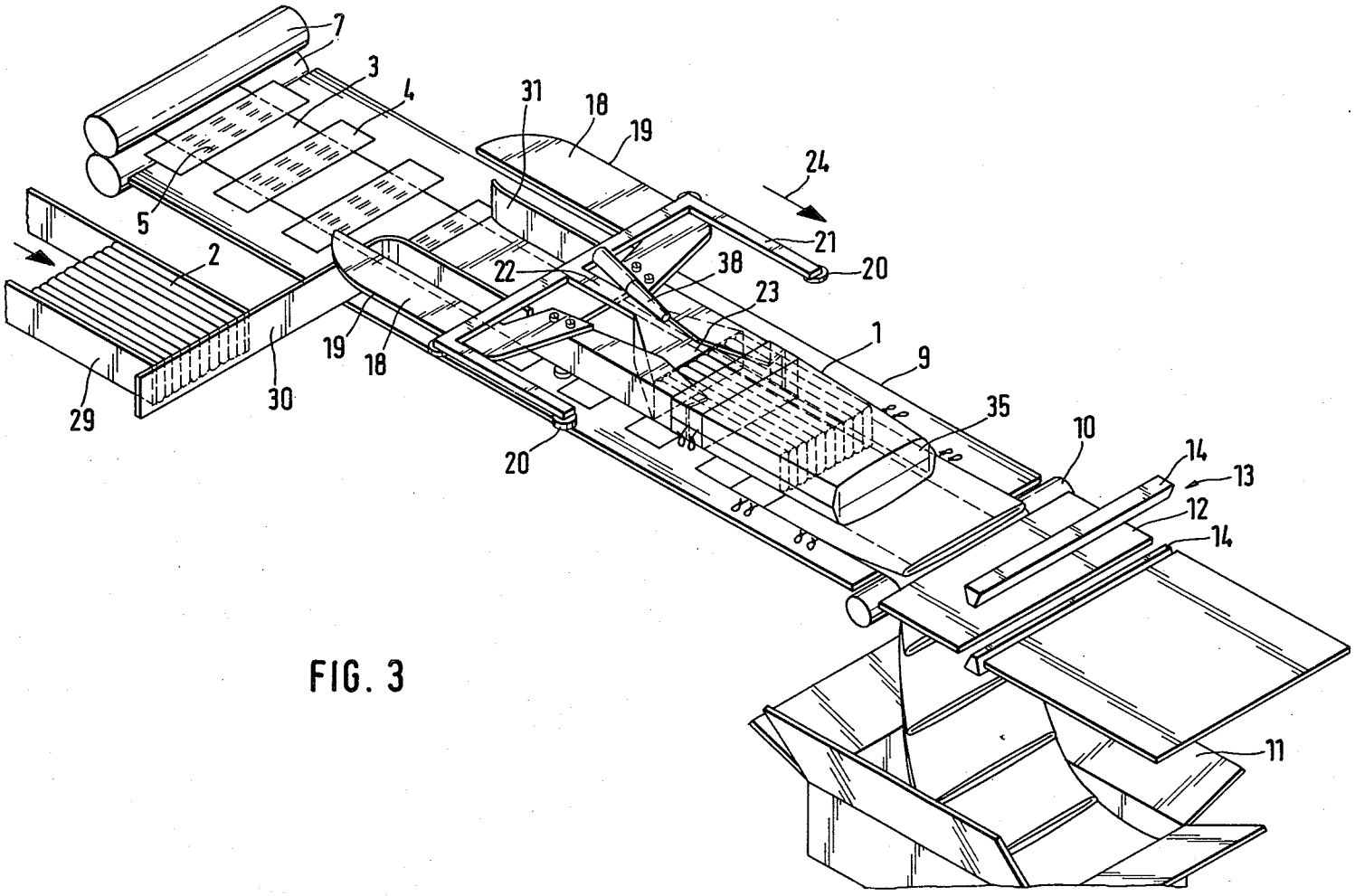
FIG. 3 is an illustration of the apparatus of FIG. 1 after the goods have been inserted in the open bag.

The apparatus illustrated in perspective in FIGS. 1–5 is intended to perform the automatic filling of bags 1 with soft contents of goods 2, for example sanitary napkins, etc. For this purpose the empty bags 1 are supplied in sequence and in an overlapping fish scale-like manner on a carrier web 3 which may be, for example, of plastic and on which they are fastened permanently and relatively immovably by an extending attachment flap. For example, each bag, which may be a drawstring bag and is made of plastic, has an extending flap 4 which is heat welded at areas 5 to the carrier web 3. The distance A between two successive flaps (FIG. 1) is approximately the same and depends on the size and format of the bags 1. The carrier web proceeds in a direction such that the bags arrive with the opening in front and they are transported into a bag filling station 6. The bag filling station 6 includes a conveyor mechanism including a pair of pressure rollers 7 which are driven cyclically by means not shown so as to impart to the carrier web 3 a stepwise motion in the direction of the arrow 8 (FIG. 2).

The transport rollers 7 pull the carrier web 3 over a horizontal table 9 at the end of which there is mounted a deviating roller 10 which imparts a right angle deviation to the carrier belt 3 which is pulled from a zig-zag layer stack in a box 11. At the other side of the roller 10, there is located a horizontal support 12 which, together with the roller 10, defines a slot through which the web 3 is pulled without hindrance.

The support 12 carries a heat welding device 13 having welding jaws 14 (see FIG. 2) which may be moved in the direction of the arrow to perform a bag closure. Disposed above the table 9 is a filling funnel 15 having two jaws which are pivotable about vertical axes 16 and whose cross section may be U-shaped or L-shaped.

Although the illustrated embodiment shows the funnel jaws to be pivotable in the horizontal plane, it would also be possible to dispose the funnel jaws to pivot vertically.

Each of the jaws 17 is attached to a substantially L-shaped cam plate 18 with a cam surface 19 that is followed in operation by two rollers belonging to a substantially U-shaped frame in the center of which there is rigidly attached a filling piston 23 by means of a bridge 22. The filling piston 23 and the frame 21 are movable to-and-fro in the direction of the arrows 24, 25 (FIGS. 2, 4) by means known per se, not shown. The front of the piston 23 has a flat surface 27 and tapering sides 28 which thus impart to the piston 23 a generally triangular shape which narrows in the direction of the bridge 22.

Located adjacent to the table 9 in the general vicinity of the roller 7 is a supply channel 29 which also contains a conveyor mechanism that supplies the goods or objects 2 in a predetermined number and quantity, i.e., in batches, to a cassette-like container 31 having a substantially U-shaped cross section. A mechanism, not shown, is capable of moving the cassette 31 in the direction of the arrow 33. During that motion the cassette 31 and its contents move beneath the cam plates 18 of the funnel 15.

Operation: In the position illustrated in FIG. 1, the foremost bag 1 is shown with an opened front and with the jaws 17 of the filling funnel 15 inserted in the back. At this point, the carrier web 3 is not moving. The filling piston 23 is shown to be retracted in the end position of the delivery direction 8 and the actuating rollers 20 on the frame 21 are disengaged from the cam surfaces 19 of the cam plates 18 so that a spring, not shown, is able to cause the jaws 17 of the funnel 15 to move toward one another. The cassette 31 which is open in front is now moved in the direction of the arrow 33 toward the table 9 so that a quantity of goods 2 is transferred into the position illustrated in FIG. 2 while the stop 30 closes off the supply to the channel 29.

After the cassette 31 has brought the goods 2 in the position in front of the end face 27 of the piston 23, the piston is then moved forward in the direction of the arrow 24 (FIG. 2). During this motion, the actuating rollers 20 engage the cam surfaces 19 and cause the funnel jaws 17 to pivot outwardly, thereby further opening the mouth of the bag 1 which is to be filled. At the same time, the motion of the piston causes the placement of the contents of the cassette 31 into the bag 1 in the manner illustrated in FIG. 3 while the bag 1 is held in position by the stationary carrier web 3 to which it is attached by its extending flap.

Figure 4:
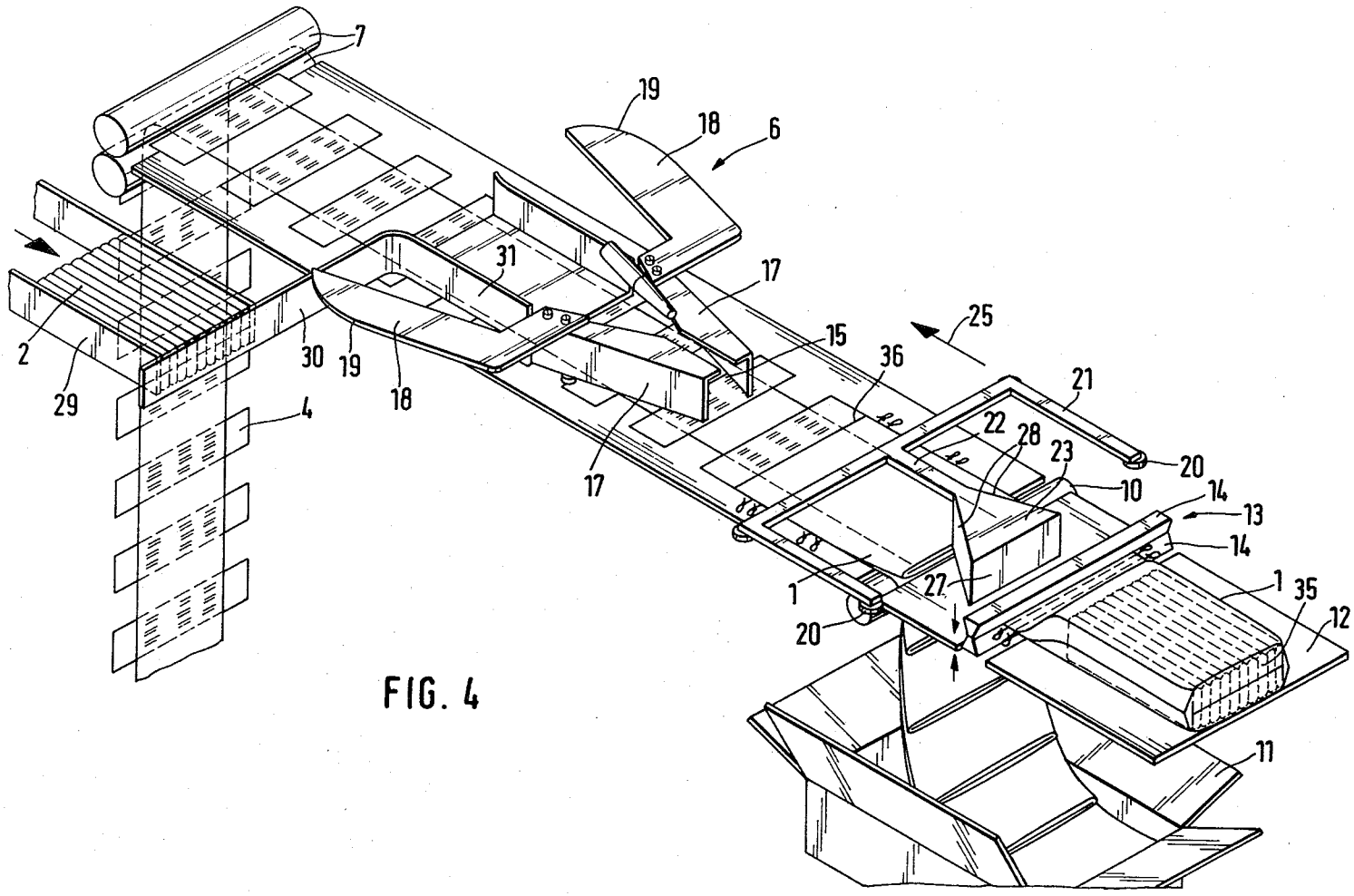
FIG. 4 is an illustration of the apparatus of FIG. 1 during bag closure.
Figure 5:
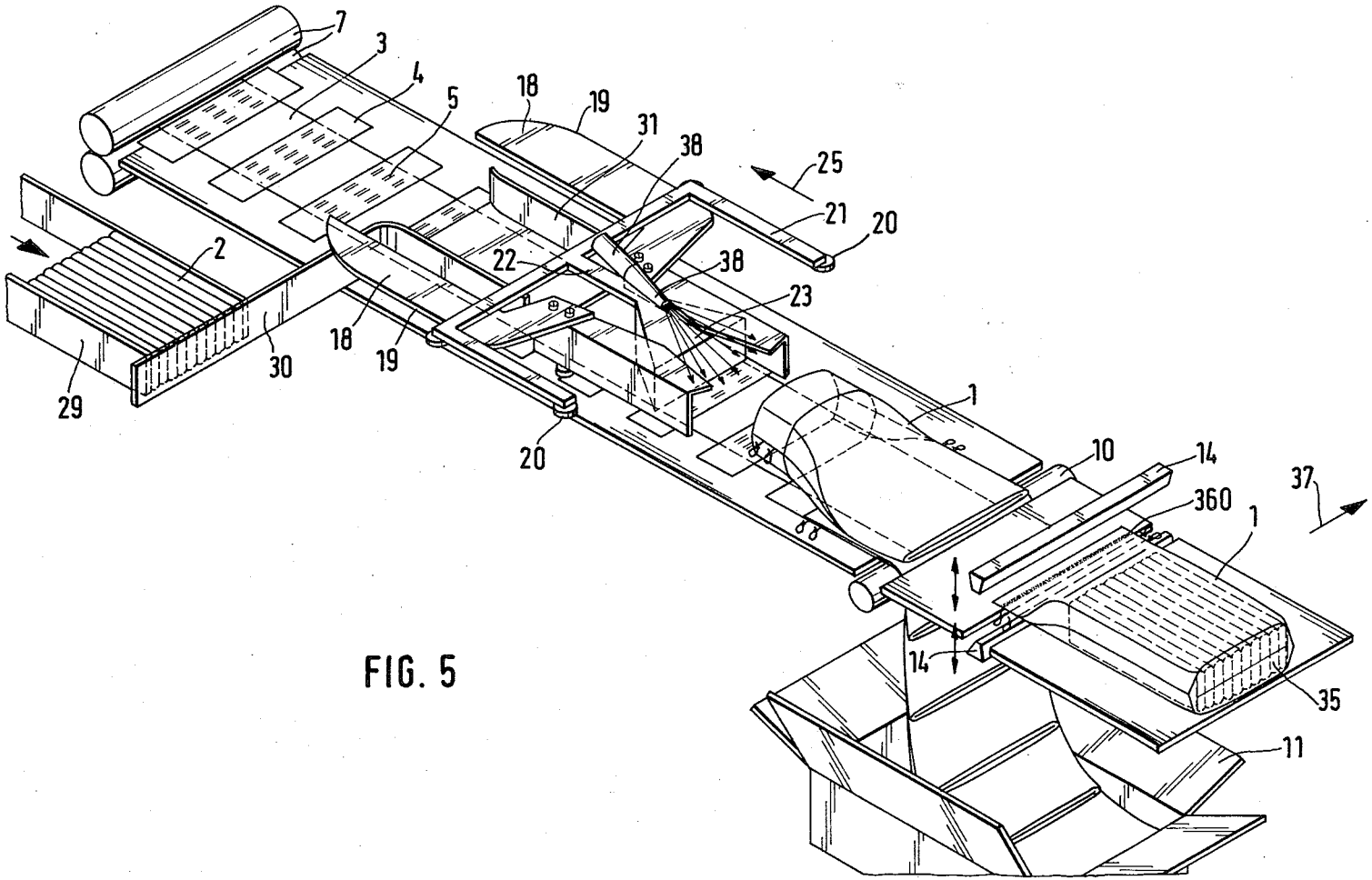
FIG. 5 is an illustration of the apparatus of FIG. 1 at the point of opening of a subsequent bag.
Figure 6:
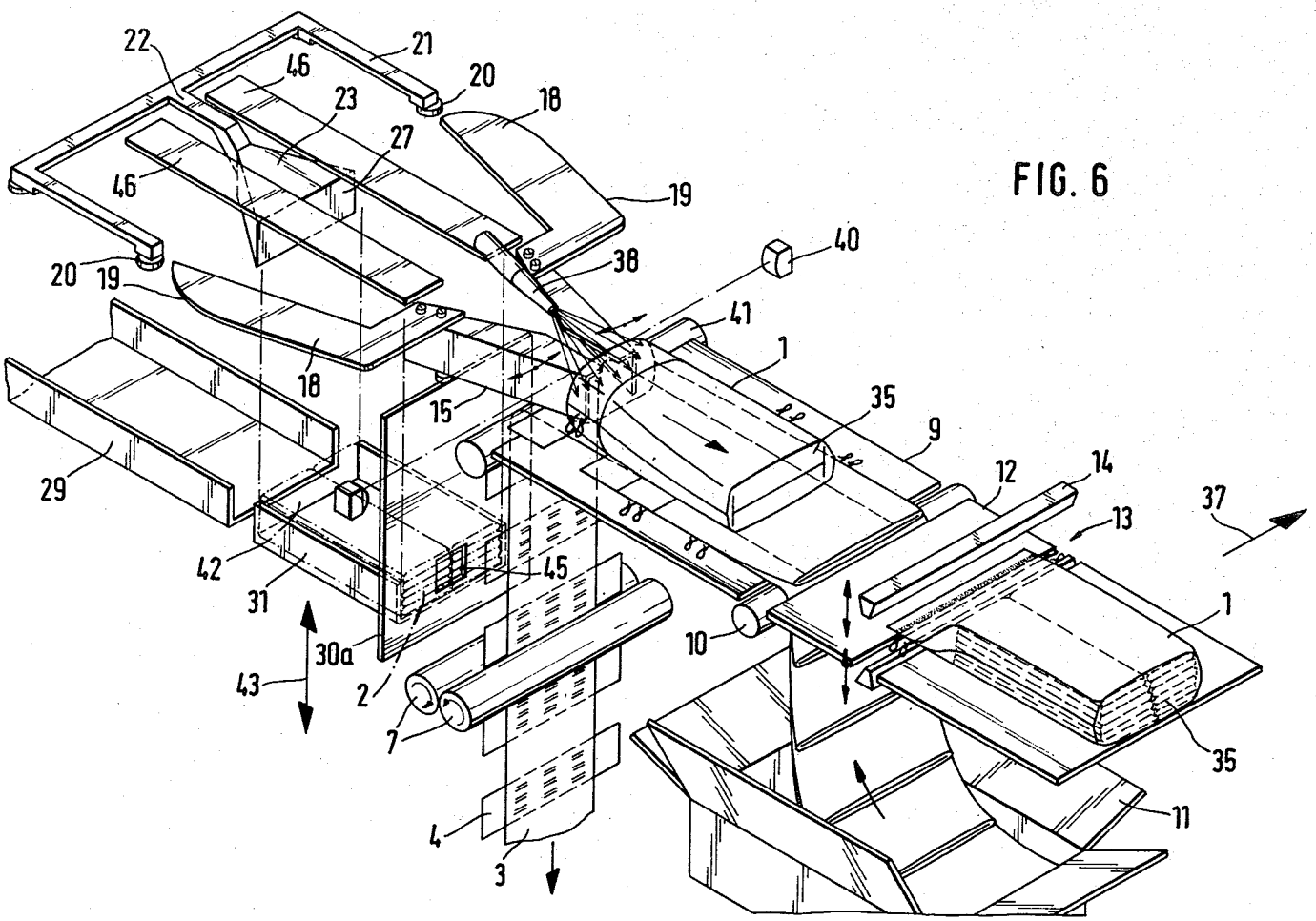
FIG. 6 is a perspective view of a variant of the apparatus of FIG. 1 in which the supply of empty bags arrives vertically.

During the motion described above, the goods 2 are pressed against the bottom 35 of the bag. In the continued forward motion of the filling piston 23 in the direction of the arrow 24, the now filled bag 1 is pulled and separated along a line of perforations 36 (FIG. 4), from the attachment flap 4 which remains in position on the carrier web. The bag is pushed into a closure and transport position on the support surface 12, as illustrated in FIGS. 4–6. In the first step, the mouth of the bag is placed within the opened sealing jaws 14 of the closure mechanism. The jaws 14 close in the direction indicated by arrows in FIG. 4 and thus seal the bag 1 along a line 360 (FIG. 5) whereafter the jaws 14 separate, permitting the now closed bag 1 to continue in the direction of the arrow 37 (FIG. 5) where they may be transported by a further conveyor mechanism, not shown.

After the now filled bag 1 has been transported through the open welding jaws 14, the filling piston 23 reverses its motion and returns in the direction of the arrow 25 (FIGS. 4, 5) whereafter the welding jaws 14 seal the bag 1 in the manner described above. During the return motion of the filling piston 23, the two jaws 17 are spread apart by the tapering sides 28 of the piston 23 and permit its unimpeded passage. At this time, the pressure rollers 7 are engaged and cause the carrier web 3 to be advanced by one step in the direction of the arrow 8, thereby moving the next empty bag 1 into position for filling. During the return motion of the filling piston 23, approximately at the position illustrated in FIG. 5, it engages a control valve, not shown, causing a nozzle 38 to be supplied with compressed air which is directed into the opening of the next bag 1. The air opens the next to be filled bag in the manner illustrated in FIG. 5 in which position it is moved toward the jaws of the filling funnel 15. In the meantime, the filling piston 23 has left the area of the funnel 15 and the rollers 20 have released the cam surfaces 19, permitting the spring, not shown, to pull the funnel jaws 17 inwardly as indicated in FIG. 6 by arrows. In the continuing motion of the carrier web 3, the next bag 1 is pushed on the funnel 15 until it reaches the position illustrated in FIG. 1 at which point the supply of compressed air out of the nozzle 38 is turned off, the pressure rollers 7 are stopped and the filling process may begin anew as described above.

In order to insure that the carrier web is stopped at the exact point at which the opening of the bag is correctly positioned on the funnel 15, there is provided a photoelectric gate 40 (FIG. 6) which actuates the drive motor of the pressure rollers 7 via a suitable electrical control circuit.

The apparatus also includes a programmed control mechanism, not shown, which synchronizes the individual motions and drives of the various components, for example the drive means of the filling piston 23, the motions of the cassette 31, of the closure device 12 and of the transport rollers 7. The programmed control mechanism also permits attaching the apparatus of the invention to any production machine which produces the objects 2 by using an appropriate electrical or other signal for initiating the bag filling process.

The bag 1 may be sealed in any suitable manner; the bag closure mechanism would then be adapted to the manner of closing.

The empty carrier web 3 from which the bags have been removed but which still carries the attachment flaps 4, may be stored behind the rollers 7 in suitable manner, for example by being spooled on a roll.

In the embodiment illustrated in FIGS. 1–5, the pressure rollers 7 are shown to be located substantially in the plane of the table 9 and behind the rearmost position of the frame 21. However, in a variant of the invention illustrated in FIG. 6, the rollers 7 may be disposed below the table 9 and the carrier web 3 may be supplied as previously shown but deviated by a roller 41 to depart from the apparatus in a downward motion. The arrangement according to FIG. 6 makes it possible to save space and to supply the goods to be placed in the bags in stacks 42 which are lifted by a mechanism, not shown, into the region in front of the face 27 of the filling piston 23. Such a construction may be advantageous for reasons of available space. The goods which are received from a production machine, not shown, then arrive through a conveyor channel 29 and are inserted in stacks in the cassette 31 until they make contact with a sensor 45 which is used by the production machine and/or the apparatus of the invention to initiate further steps.

When the contents of the bags are elastic and soft, e.g. sanitary napkins, cotton products and the like, it is necessary for reasons of appearance to present a fully filled, bulging package. This may be accomplished by slightly compressing the goods prior to insertion in the bags 1. In the embodiment illustrated in FIGS. 1–5, this slight compression of the goods 2 is a lateral compression.

In the embodiment illustrated in FIG. 6, the compression is obtained by the presence of two horizontal stop rails 46 located above the filled piston 23 against which the cassette 31 presses the goods 2 in its upward travel prior to insertion in the bag 1.

Figure 7:
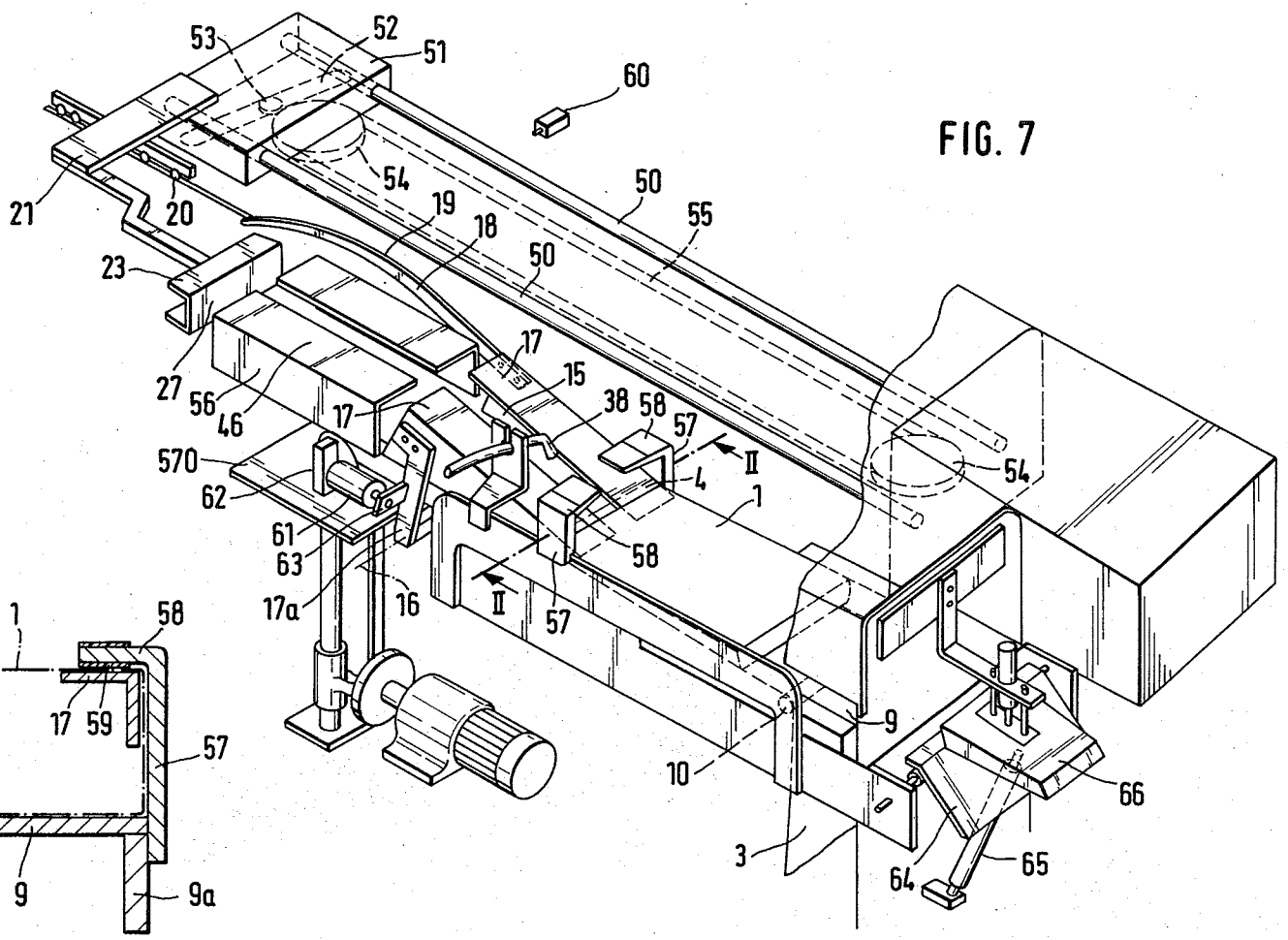
FIG. 7 is a second embodiment of the invention in perspective view.
Figure 8:
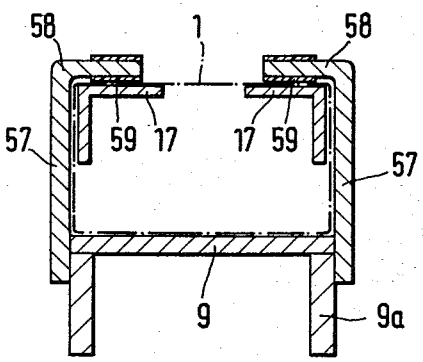
FIG. 8 is a section of the apparatus of FIG. 7 along the line II—II.

Another embodiment of an apparatus of the invention in which a vertical supply of goods is employed is illustrated in FIG. 7. This apparatus includes a supply mechanism 57 which presses the goods upwardly against stops 46.

The apparatus as shown in FIG. 7 operates substantially similarly to that already described and many of its components have the same function and reference numerals. The construction of FIG. 7 is different from the previously described in that the jaws 17 of the filling funnel are attached on an arm 17*a* which is pivotable about a horizontal axis 16.

One of the jaws 17 is attached to a cam surface 19 that cooperates with actuating rollers 20 that are attached to elements 21 connected to the filling piston 23. Located adjacent to the table 9 are guide rails 50 on which a slide 51 may move to-and-fro. The underside of the slide 51 carries a slotted lever 52 in which travels a follower 53 attached to an endless chain 55 traveling on two rollers 54. One of the rollers 54 is powered through a controllable clutch by a drive motor, not shown.

The filling piston 23 is rigidly attached to the frame member 21 and hence to the slide 51 as illustrated in FIG. 7 so that it shares the to-and-fro motion of the slide 51 imparted by the chain 55.

A guide foil 56 consisting of two angled sheets of metal also acts as a vertical arrest 46 for the goods which are delivered by a mechanism 57, not shown in detail, which delivers and places the goods in front of the filling piston 23. By being compressed against the arrest 46, elastic goods are slightly reduced in size and increased in density which insures a full and bulging content of the bag.

Mounted on the table 9 in the vicinity of the tips of the jaws 17 of the funnel 15 are two brackets 57 whose upper portions 58 are above the table 9 and substantially parallel thereto. The legs 58 of the brackets 57 are coated with an elastic plastic material 59.

The apparatus illustrated in FIG. 7 operates substantially in the same manner as already described with respect to the embodiment of FIGS. 1–5, i.e., as follows.

By suitable cyclic forward motion of the carrier web 3, the foremost bag 1 is slipped over the downward pointing filling funnel 15 after being subjected to pressurized air emerging from a nozzle 38, causing its initial opening. Subsequently, the supply mechanism 57 places the goods into a position ahead of the filling piston 23 and in contact with the arrest 46 from which position the piston 23 pushes it into the filling funnel 15. During this motion, the rollers 20 pass over the cam surface 19, causing the funnel 15 to pivot upwardly and further open the bag 1. During the upward motion of the jaws 17, they come in contact with the horizontal parts 58 of the brackets 57 so that the top part of the mouth of the bag is compressed against the elastic surfaces 59. This pressure which locates and holds the top part of the bag opening and the positive attachment of the extending flap 4 of the bag to the web 3 positively locate the bag for the subsequent filling operation. The fully opened position of the jaws 17 against the bracket parts 58 is insured in the subsequent motion of the piston 23 by a hydraulic or pneumatic cylinder 61 which is mounted on a support 62 and acts against the extension 63 of the arm 17*a* to hold the jaws open. The cylinder 61 is actuated by air from a suitable source under the control of a microswitch 60 which is engaged by the slide 51 during its passage. The degree of compression of the air in the cylinder 61 and hence the force with which the jaws 17 are placed against the parts 58 is adjustable with a suitable pressure control valve, not shown.

During its further forward motion, the piston 23 pushes the goods against the bottom of the bag 1 so that any subsequent motion of the piston 23 causes the bag to be torn from its attachment flap 4 which remains attached to the web 3. The separation occurs along an intentional tear line between the flap and the bag. The continued motion of the piston 23 then displaces the bag from the clamping position between the jaws 17 and the elastic surfaces 59.

After its closure by means not shown, the bag is pushed over a guide foil 64 supported by a cylinder 65 and a hold-down device 66 which serves to decelerate the bag that may have acquired substantial forward speed due to the motions of the piston 23.

When the filling piston 23 is returned, the funnel 15 remains open until the piston 23 has departed therefrom.

Thereafter, the pressure in the pneumatic cylinder 61 is relieved, permitting the funnel 15 to assume the position illustrated in FIG. 1 so that the next bag 1 may be moved forward over the funnel 15 by cyclic forward motion of the carrier web 3 in the manner already described.

The foregoing description relates to preferred exemplary embodiments of the invention. Various changes and modifications may be made and features described in connection with one of the embodiments may be used with any other within the scope of the inventive concept.

I claim:

1. A method for automatic filling of container bags, said method including supplying empty bags on a carrier web at a scheduled cyclic rate, opening the first bag by means of an opening funnel, placing the goods in the bag and removing the bag from the carrier web and wherein, according to the invention, the method comprises the steps of:

supplying said bags with extending flaps which are permanently attached to the carrier web;

opening the first bag while the bag is attached to the carrier web;

moving the opened bag into a predetermined position with its mouth over the end of the opening funnel so that the opening funnel extends into the bag to spread the mouth thereof and to provide guide surfaces for the fill goods;

holding the bag open;

placing the goods in the bag by means of a moving filling piston; and causing the separation of said bag from the extending flap along a tear line by pressing the goods against the bottom of the bag, while leaving the flap permanently attached to the carrier web.

2. A method according to claim 1, wherein said opening funnel is spreadable in a vertical direction.

3. A method according to claim 1, wherein said first bag is at least partially opened by the admission of compressed air.

4. A method according to claim 2, wherein the spreading of said opening funnel is coupled to the motion of the bag filling piston.

5. A method according to claim 4, wherein goods equal to the contents of one bag are placed in front of the filling piston in a direction at right angles to the direction of motion of the piston.

6. A method according to claim 2, wherein the filling funnel is automatically closed after the filled bag is removed therefrom.

7. A method according to claim 1, including the step of sensing the position of the next unfilled bag and advancing the carrier web by a step which places said next unfilled into its predetermined position.

8. A method according to claim 1, including the step of clamping the bag at least temporarily in place on the opening funnel during the bag-filling process.

9. A method according to claim 8, wherein the clamping step comprises holding the bag by clamping the bag between the opening funnel and a locally fixed counter element.

10. Method according to claim 1, wherein the funnel comprises movable jaws, and said step of holding the bag open comprises spreading said jaws apart.

11. Method according to claim 1, wherein the step of moving the open bag with its mouth over the end of the funnel comprises linearly moving the bag with respect to the funnel.

12. Method according to claim 11, wherein the step of linearly moving the bag with respect to the funnel comprises guiding the jaws of the funnel in the predetermined position and longitudinally moving the web, with the bag attached thereto with the respect to the jaws.

13. Method according to claim 1, wherein the goods are compressible;

said method including the step of pre-compressing the goods as they are being moved by the moving filling piston.

14. An apparatus for automatic filling of container bags, said apparatus including a cyclically actuated conveyor mechanism for imparting step-wise motion to a carrier web, on which empty bags are seriatim permanently attached by a portion thereof;

a bag-opening mechanism; and a bag-filling mechanism including a spreadable filling funnel, the conveyor mechanism moving the first attached bag with its mouth over the end of the filling funnel until the filling funnel extends into the bag;

a bag-filling means (23) movable in the direction opposite to the direction of the advance of said carrier web (3) for pushing goods into said bag (1), through said filling funnel, said filling funnel guiding the goods being pushed into the bag, and the motion of said means (23) beig sufficiently long and forceful to cause fracture and separation of said bag (1) from the portion (4) thereof attached to said carrier web (3), and transport to a subsequent station.

15. An apparatus according to claim 14, wherein said filling funnel (15) includes elastic means urging it into a closed position.

16. An apparatus according to claim 14, wherein the motion of said filling piston (23) and said spreadable funnel (15) are coupled and the spreading motion of said funnel (15) is derived from the linear motion of said filling piston (23).

17. An apparatus according to claim 14, further comprising a deviating location (10) for imparting a rectangular deviation to said carrier web and wherein said subsequent station is located behind said deviating location (10) in the sense of the direction of advance (8) of the carrier web (3).

18. An apparatus according to claim 14, wherein said subsequent station is a bag-closing station including a cyclically operating bag-welding device (14) for sealing the bags (1).

19. An apparatus according to claim 16, including a cam plate (18) coupling said piston (23) and said filling funnel (15), the cam plate being attached to a spreadable portion (17) of said funnel (15) and which automatically engages portions of said filling piston (23).

20. An apparatus according to claim 14, further comprising a conveyor mechanism (29, 31) for conveying the goods (2) to be filled in the bags into the region in the vicinity of said filling piston (23) and in a direction (33) transverse to the direction of motion (8) of said carrier web (3).

21. An apparatus according to claim 14, wherein said bag-opening mechanism comprises a compressed air nozzle (38) which directs a stream of compressed air into the mouth of the foremost bag (1) on said carrier web (3), said nozzle (38) being controlled by motions of said carrier web (3).

22. An apparatus according to claim 21, wherein said nozzle (38) is controlled by the reverse motion of said filling piston (23).

23. An apparatus according to claim 14, further comprising position sensor means (40) for sensing the position of the foremost bag (1) on the carrier web (3).

24. An apparatus according to claim 14, further comprising a programmed control mechanism for coordinating the motions of said transport rollers (7), said compressed air nozzle (38) and said filling mechanism (23, 15).

25. An apparatus according to claim 14, wherein said conveyor mechanism for imparting motion to said carrier web (3) is a pair of pressure rollers (7) located beneath said bag-filling mechanism (23, 15) and wherein said apparatus includes a goods conveyor mechanism which conveys the goods (2) to the vicinity of the bag-filling mechanism (23, 15) in the vertical direction.

26. An apparatus according to claim 14, wherein said bag-filling mechanism (23, 15) includes a horizontal arrest (46) against which the goods (2) may be compressed.

27. An apparatus according to claim 25, wherein the goods conveyor mechanism includes a channel-like open cassette (31) of substantially U-shaped cross section and a vertical stop surface (30*a*) along which the cassette (31) containing a stack of goods (42) may be moved vertically against said arrest surface (46).

28. An apparatus according to claim 21, further comprising a signal generator (45) disposed in the vicinity of said vertical stop surface (30*a*) for controlling the supply of goods.

29. An apparatus according to claim 14, further comprising a locally fixed stop (58) which is disposed to cooperate with portions of said filling funnel to pinch portions of a bag (1) during the filling process.

30. An apparatus according to claim 29, wherein said stop (58) is provided with elastic parts (59) in the vicinity of its cooperation with said filling funnel (15).

31. An apparatus according to claim 29, further comprising a cyclically actuatable power source (61) for holding said filling funnel in the spread position independently of the status of said filling piston (23) but controlled by the motions thereof.

32. An apparatus according to claim 31, including means for holding said filling funnel (15) in the open spread position during the return of said filling piston (23) into its initial position.

33. Apparatus according to claim 14, wherein the goods to be filled in the container bag are compressible;

said apparatus further including compression means pre-compressing the goods upon being placed into said bag.

34. Apparatus according to claim 33, wherein the spreadable filling funnel comprises a pair of movable jaws (17) and the compression means comprises guide surfaces formed on said jaws.

35. Apparatus according to claim 33, wherein the compression means comprises stationary guide surfaces located in advance of the mouth of the bag and positioned to be engaged by the goods as the goods are pushed into the bag by the bag filling means.

* * * * *